US008942353B2

(12) United States Patent
Tiearney, Jr. et al.

(10) Patent No.: US 8,942,353 B2
(45) Date of Patent: Jan. 27, 2015

(54) FIELD ASSISTED SINTERING OF X-RAY TUBE COMPONENTS

(71) Applicant: General Electric Company, Schenectady, NY (US)

(72) Inventors: Thomas Carson Tiearney, Jr., Waukesha, WI (US); Gregory Alan Steinlage, Hartland, WI (US); Kirk Alan Rogers, Chagrin Falls, OH (US); Ben David Poquette, Wauwatosa, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/914,679

(22) Filed: Jun. 11, 2013

(65) Prior Publication Data

US 2014/0362977 A1 Dec. 11, 2014

(51) Int. Cl.
*H01J 35/08* (2006.01)
*H01J 9/14* (2006.01)

(52) U.S. Cl.
CPC . *H01J 35/08* (2013.01); *H01J 9/14* (2013.01); *H01J 2235/085* (2013.01)
USPC ..... 378/143; 378/121

(58) Field of Classification Search
CPC ..... H01J 35/00; H01J 35/02; H01J 35/16; H01J 35/108; H01J 35/08; H01J 2235/08; H01J 2235/083; H01J 2235/084; H01J 2235/085; H01J 2235/081; H01J 2235/088
USPC ..... 378/119, 121, 122, 143, 210; 419/1, 6, 419/32, 34
See application file for complete search history.

(56) References Cited

U.S. PATENT DOCUMENTS

| | | | |
|---|---|---|---|
| 7,175,303 | B2 | 2/2007 | Kovacik et al. |
| 8,280,008 | B2 | 10/2012 | Reis et al. |
| 2010/0284520 | A1 | 11/2010 | Reis et al. |

FOREIGN PATENT DOCUMENTS

| | | | |
|---|---|---|---|
| JP | 2003027108 | A | 1/2003 |
| JP | 2007023365 | A | 2/2007 |
| KR | 102008048816 | A | 6/2008 |

OTHER PUBLICATIONS

International Search Report and Written Opinion for PCT/US2014/039950, mail date Sep. 24, 2014, 13 pages.

*Primary Examiner* — Jurie Yun
(74) *Attorney, Agent, or Firm* — Ziolkowski Patent Solutions Group, SC

(57) ABSTRACT

A system and method for x-ray tube components is disclosed. The method of fabricating an x-ray tube component includes providing a powder into an electrically conductive die constructed to have a cavity shaped as the x-ray tube component being fabricated and simultaneously applying a mechanical pressure and an electric field to the die so as to cause sintering of the powder and thereby fabricate the x-ray tube component, wherein the electric field applied to the die directly passes through the die to the powder, so as to generate heat internally within the powder responsive to the applied electric field.

16 Claims, 5 Drawing Sheets

FIELD ASSISTED SINTERING OF X-RAY TUBE COMPONENTS

BACKGROUND OF THE INVENTION

Embodiments of the invention relate generally to x-ray tubes and, more particularly, to a method of fabricating x-ray tube components.

Traditional x-ray imaging systems include an x-ray source and a detector array. X-rays are generated by the x-ray source, pass through an object, and are detected by the detector array. Electrical signals generated by the detector array are conditioned to reconstruct an x-ray image of the object.

In general, the x-ray source is in the form of an x-ray tube that includes a vacuum housing enclosing an anode assembly and a cathode assembly. The cathode assembly includes an electron emitting filament that is capable of emitting electrons. The anode assembly provides an anode target that is spaced apart from the cathode and oriented so as to receive electrons emitted by the cathode. In operation, electrons emitted by the cathode filament are accelerated towards a focal spot on the anode target by placing a high voltage potential between the cathode and the anode target. These accelerating electrons impinge on the focal spot area of the anode target. The anode target is constructed of a high refractory metal so that when the electrons strike, at least a portion of the resultant kinetic energy generates x-radiation, or x-rays. The x-rays then pass through a window that is formed within a wall of the vacuum enclosure, and are collimated towards a target area, such as a patient. As is well known, the x-rays that pass through the target area can be detected and analyzed so as to be used in any one of a number of applications, such as a medical diagnostic examination.

In general, only a very small portion—approximately one percent in some cases—of an x-ray tube's input energy results in the production of x-rays. In fact, the majority of the input energy resulting from the high speed electron collisions at the target surface is converted into heat of extremely high temperatures. This excess heat is absorbed by the anode assembly and is conducted to other portions of the anode assembly and to the other components that are disposed within the vacuum housing.

Because of the heat generated in the x-ray tube during operation, it is required that many components in the x-ray tube—such as the anode assembly (target and shaft), cathode cup, electron collector, etc.—be formed of a refractory material that is configured to withstand the high operating temperatures in the x-ray tube. Such refractory materials can include, for example, tungsten, molybdenum, and/or molybdenum alloys, such as molybdenum with additives of titanium, zirconium, and carbon ("TZM").

Typically, such refractory x-ray tube components are manufactured via a press-sinter-forge (PSF) process, hot-pressing process, or hot isostatic pressing process. Such production processes have inherent drawbacks that cannot be overcome—with such drawbacks including achievable material density and process cycle time, according to the specific process employed. With respect to a PSF process, for example, the separate steps of pressing metal powders to form a compacted "green" shape" or "pre-form," sintering the pre-form, and close-die forging the pre-form to form a final component, lead to an increased cycle time that is undesirable from a cost and business standpoint.

Therefore, it would be desirable to provide a process for manufacturing refractory x-ray tube components having a reduced cycle time. If would also be desirable for such a process to provide the components as near-net-shape components and as full density/near-full density material components.

BRIEF DESCRIPTION OF THE INVENTION

Embodiments of the invention provide a method that overcomes the aforementioned drawbacks.

According to one aspect of the invention, a method of fabricating an x-ray tube component includes providing a powder into an electrically conductive die constructed to have a cavity shaped as the x-ray tube component being fabricated and simultaneously applying a mechanical pressure and an electric field to the die so as to cause sintering of the powder and thereby fabricate the x-ray tube component, wherein the electric field applied to the die generates heat internally in the die that is passed to the powder, so as to heat the powder responsive to the applied electric field.

According to another aspect of the invention, a method of fabricating an x-ray tube component useable in an x-ray tube includes providing a powder into an electrically conductive die, wherein the powder comprises one of a refractory metallic powder, a non-refractory metallic powder, and a ceramic powder, and wherein the die is constructed to have a cavity shaped as the x-ray tube component being fabricated. The method also includes compacting the powder into the electrically conductive die and prepping a volume about the die for a subsequent sintering operation, wherein prepping the volume comprises one of creating a vacuum environment about the die or introducing an inert or reducing gas about the die. The method further includes performing a field assisted sintering technology (FAST) process to sinter the powder and thereby fabricate the x-ray tube component.

According to yet another aspect of the invention, an x-ray tube component that is configured for use in an x-ray tube is fabricated by providing a powder into an electrically conductive die constructed to have a cavity shaped as the x-ray tube component being fabricated and simultaneously applying a mechanical pressure and an electric field to the die so as to cause sintering of the powder and thereby fabricate the x-ray tube component, wherein the electric field applied to the die generates heat internally in the die that is passed to the powder, so as to heat the powder responsive to the applied electric field.

Various other features and advantages of the present invention will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION

Embodiments of the invention are directed to a process for manufacturing x-ray tube components. A field-assisted sintering technology (FAST) process, also known as spark plasma sintering (SPS), is employed to generate x-ray tube components, with the FAST process providing for a reduced cycle time in manufacturing the component(s), and with the component(s) being provided as near-net-shape components and as full density/near-full density material components.

Figure 1:
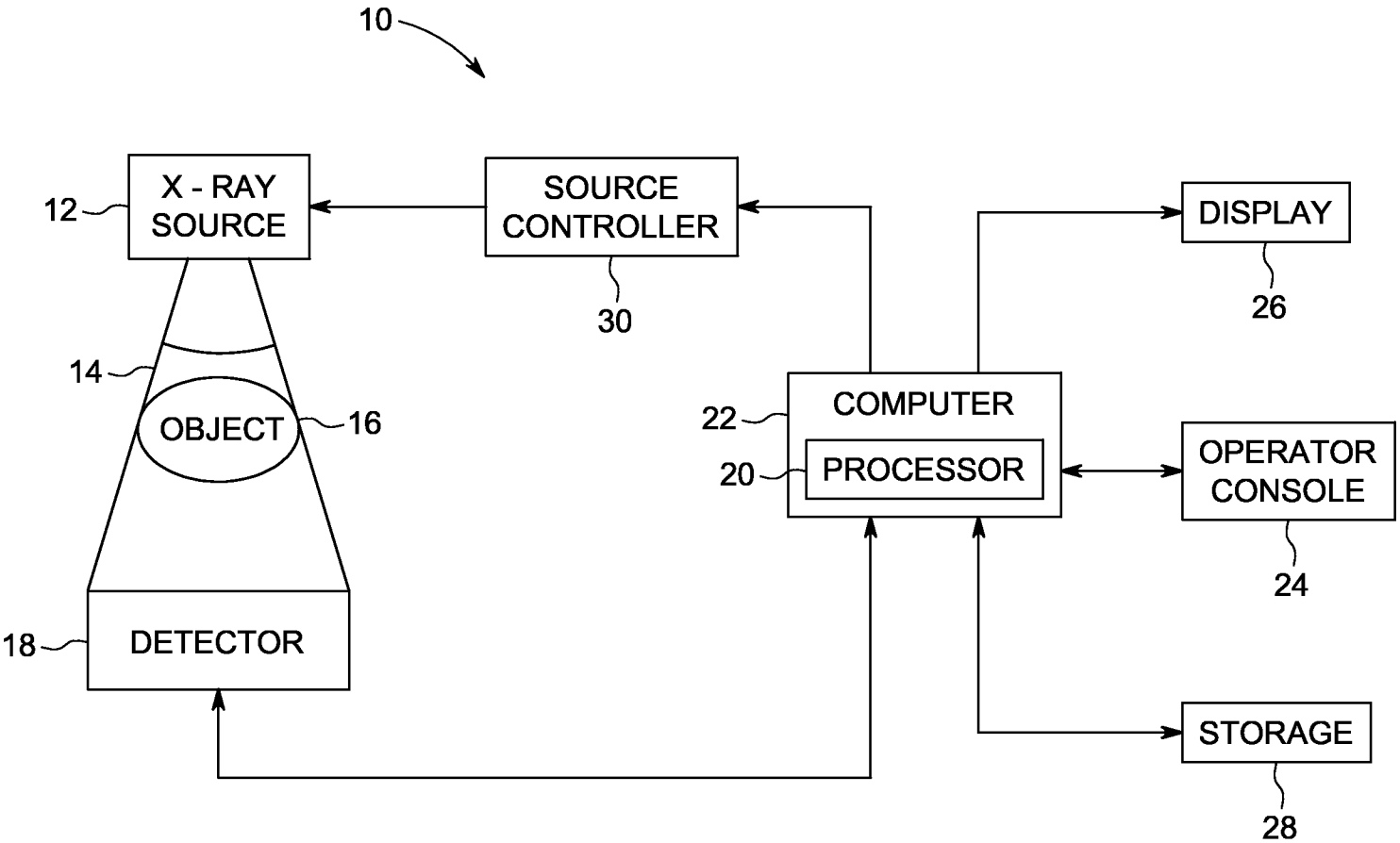
FIG. 1 is a block diagram of an imaging system that can benefit from incorporation of an embodiment of the present invention.
Figure 2:
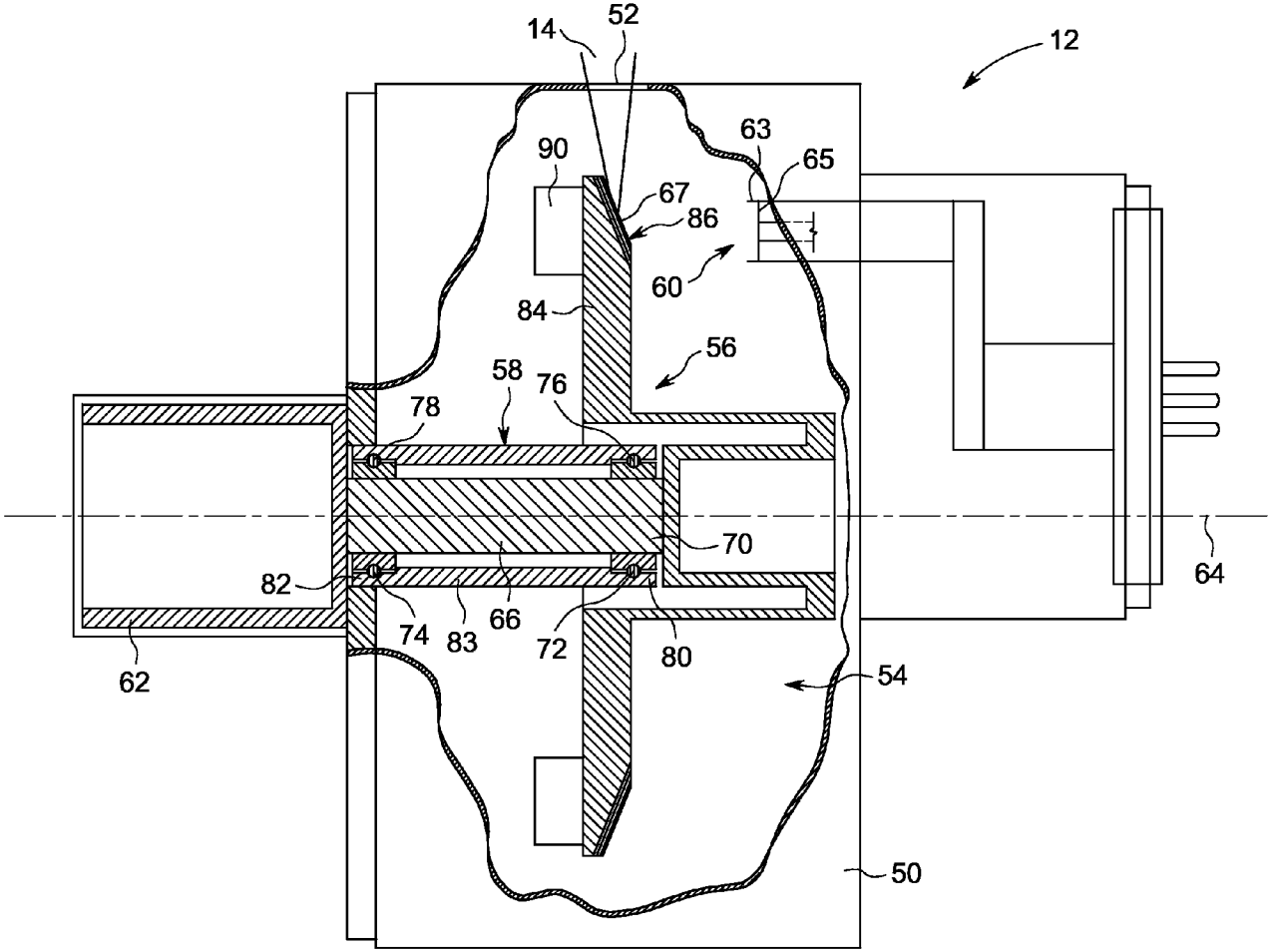
FIG. 2 is a cross-sectional view of an x-ray tube that can benefit from incorporation of an embodiment of the present invention.

Referring to FIGS. 1 and 2 an imaging system 10 (FIG. 1) and associated x-ray tube 12 (FIG. 2) for use therein are shown that can benefit from incorporation of embodiments of the present invention. It will be appreciated by those skilled in the art that embodiments of the present invention are applicable to components for x-ray tubes of varying configurations, with the x-ray tube also being implementable with numerous medical imaging systems, such as a CT system, an x-ray system, a vascular system, and a mammography system. The following discussion of x-ray system 10 and x-ray tube 12 are merely an example of one such implementation and is not intended to be limiting.

As shown in FIG. 1, an imaging system 10 designed both to acquire original image data and to process the image data for display and/or analysis includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Referring to FIG. 2, a cross-sectional view of x-ray tube 12 is illustrated having components therein that can benefit from incorporation of embodiments of the present invention. The x-ray tube 12 includes a casing 50 having a radiation emission passage 52 formed therein. The casing 50 encloses a vacuum 54 and houses an anode 56, a bearing assembly 58, a cathode assembly 60, and a rotor 62.

As shown in FIG. 2, the cathode assembly 60 includes a cathode cup 63 and an emitter or filament 65 coupled to a current supply lead and a current return (not shown). In operation, an electron beam is produced by cathode assembly 60 when one or more electrical signals (e.g., timing/control signals) are supplied to emitter/filament 65 that cause cathode assembly 60 to emit an electron beam at one or more energies and at one or more frequencies. X-rays 14 are produced when high-speed electrons in the electron beam are suddenly decelerated when directed from the cathode assembly 60 to the anode 56 via a potential difference therebetween of, for example, sixty thousand volts or more in the case of CT applications. The electrons impact a material layer or target track 86 at a point 67 and x-rays 14 emit therefrom. The point of impact is typically referred to in the industry as the focal spot 67, which forms a circular region or track on the surface of the target track 86, and is visually evident on the target surface after operation of the x-ray tube 12. The x-rays 14 emit through the radiation emission passage 52 toward a detector array, such as detector 18 of FIG. 1. To avoid overheating the anode 56 from the electrons, the anode 56 is rotated at a high rate of speed about a centerline 64 at, for example, 90-250 Hz.

As further shown in FIG. 2, the bearing assembly 58 includes a center shaft 66 attached to the rotor 62 at first end 68 and attached to the anode 56 at second end 70. A front inner race 72 and a rear inner race 74 rollingly engage a plurality of front balls 76 and a plurality of rear balls 78, respectively. Bearing assembly 58 also includes a front outer race 80 and a rear outer race 82 configured to rollingly engage and position, respectively, the plurality of front balls 76 and the plurality of rear balls 78. Bearing assembly 58 includes a stem 83 which is supported by the x-ray tube 12. A stator (not shown) is positioned radially external to and drives the rotor 62, which rotationally drives anode 56. As shown in FIG. 2, a heat storage medium 90, such as graphite, may be used to sink and/or dissipate heat built-up near the target track 63.

Referring still to FIG. 2, the anode 56 includes a target substrate 84, having target track 86 attached thereto according to an embodiment of the present invention. The target track 86 typically includes tungsten or an alloy of tungsten such as tungsten with rhenium ranging from 3-10%. The target substrate 84 typically includes molybdenum or an alloy of molybdenum such as TZM (Titanium, Zirconium, and Molybdenum).

According to embodiments of the invention, various components in x-ray tube 12, including refractory and non-refractory components, are manufactured using a field-assisted sintering technology (FAST) (i.e., spark plasma sintering (SPS) process). The FAST process employs a simultaneous application of pressure and an electric field to enhance atom mobility in a component being produced, with supplemental temperature being added to further increase mobility and reduce cycle time. The main characteristic of FAST is that a current is applied that directly passes through an electrically conductive die (e.g., graphite die), and optionally the powder of the component being fabricated (in case of an electrically conductive powder). Therefore, the heat applied for sintering is generated internally within the component, in contrast to the conventional hot pressing, where the heat is provided by external heating elements. This facilitates a very high heating or cooling rate of up to 500 C/min (e.g., 100 C/min), hence the FAST process generally is very fast (e.g., within a few minutes). The general speed of the FAST process ensures it has the potential of densifying powders with nanosize particles or nanostructure while avoiding coarsening which accompanies standard densification routes. As such, the FAST process can produce x-ray tube components having full or near-full material density—thereby potentially improving the material properties of the components, such as toughness, fatigue growth crack rate (FGCR), modulus of elasticity, dielectric constant, and/or ductile brittle transition temperature (DBTT), as non-limiting examples. Beneficially, these improved material properties can improve life of the x-ray tube components, such as by increasing a life of the anode target based on a 2 to 4× reduction in FGCR.

Figure 3:
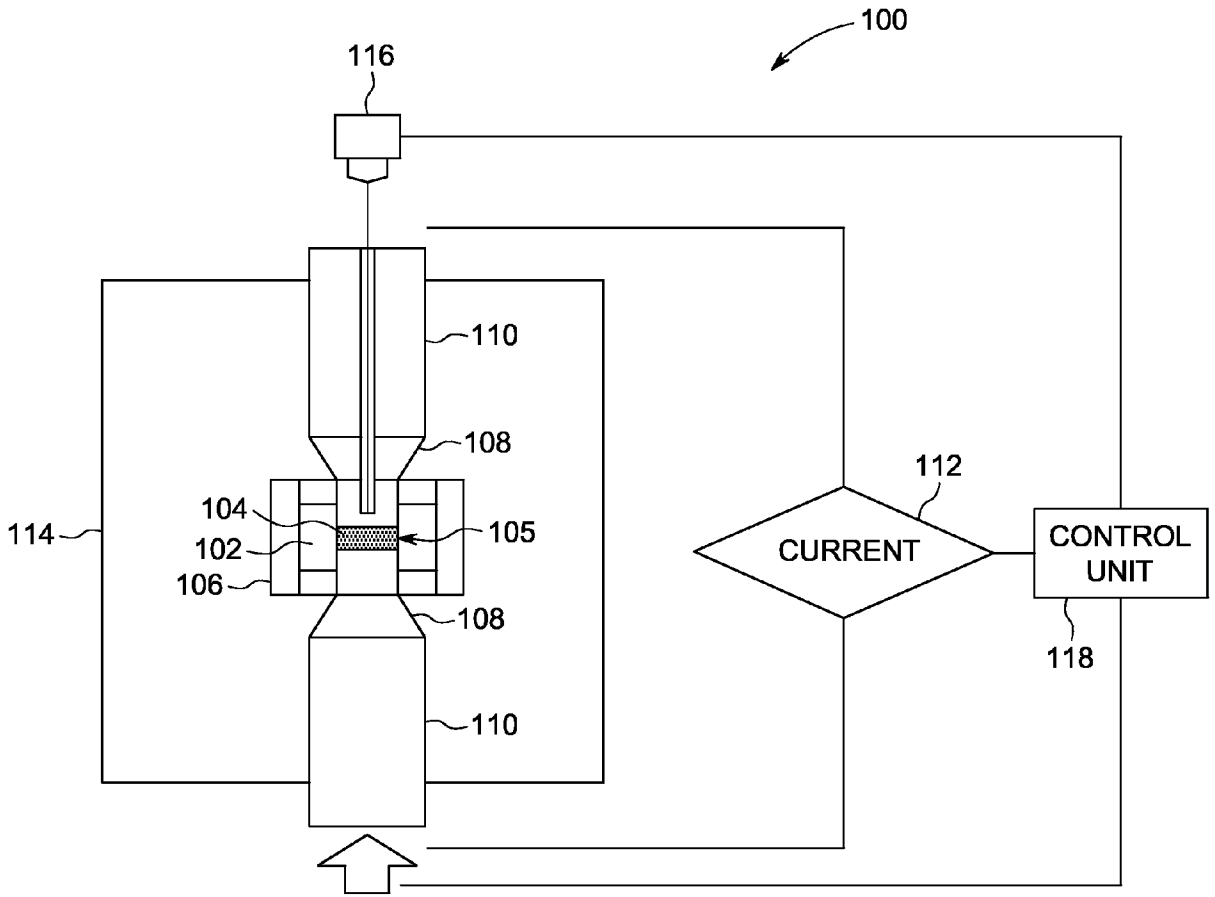
FIG. 3 is a block schematic diagram of a system for manufacturing x-ray tube components using a field-assisted sintering technology (FAST) process.

Referring now to FIG. 3, a schematic view of an exemplary production system 100 for fabricating x-ray tube components via a FAST treatment is shown. The system 100 includes an electrically conductive die 102, such as a die formed of graphite for example, in which raw materials 104 (i.e., a powder) are positioned within, such as a powdered refractory metallic material, powdered ceramic material, or powdered non-refractory metallic material are positioned within. The die 102 is constructed to have a cavity 105 for receiving the powder 104, with the cavity being shaped like/as the particular x-ray tube component being fabricated, and thus the specific shape/dimensions thereof will vary. According to one embodiment, carbon felt 106 can be positioned about the die 102 to provide thermal insulation in the inert environment provided by system 100.

A pair of up and down pair of spacers 108 are positioned on opposing sides of the die 102, with the spacers 108 being supported by punch electrodes 110 and pressed thereby at a pressure of, for example, about 1 MPa against the die 102. The spacers 108 are configured as conductive members, and a current (pulse, DC or AC) generated from a current supply 112 is supplied to the spacers 108 and the die 102 via the punch electrodes 110. The die 102, the spacers 108, and the punch electrodes 110 are placed in a vacuum chamber 114 that provides an inert environment for performing of the FAST process.

Also included in system 100 is a temperature measuring device 116, such as a pyrometer, that functions to measure the temperature of the component being fabricated in the die 102 in a non-contact manner. A control unit 118 included in system 100 drives and controls the pulse current supply 112, the pressure applied by punch electrodes 110, and the functioning of temperature measuring device 116. The control unit 118 is configured to drive the punch electrodes 110 compress the spacers 108 with a predetermined amount of pressure.

Figure 4:
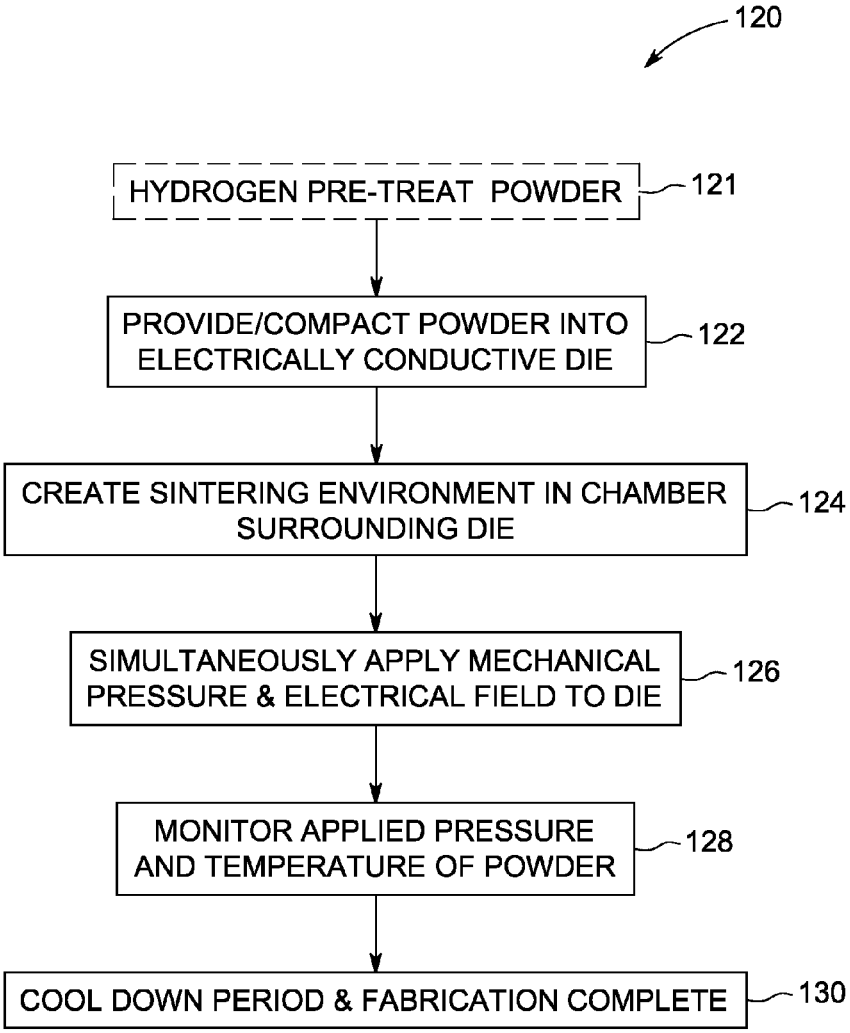
FIG. 4 is a flowchart of an x-ray tube component fabrication process according to an embodiment of the present invention.

Referring now to FIG. 4, and with continued reference to FIG. 3, a flowchart illustrating a technique 120 for fabricating/manufacturing various x-ray tube components using FAST process is provided. The technique 120 can be performed in a system such as system 100 shown in FIG. 3 or a similar suitable system, according to embodiments of the invention. The technique 120 begins at STEP 121, where a step of subjecting a powder to a hydrogen pre-treating application can be optionally performed. At STEP 122, the pre-treated powder is then provided and compacted into an electrically conductive die 102—such as a graphite die. Upon loading/compacting of the powder into die 102, a sintering environment is created about the die 102 at STEP 124, which could comprise creating a vacuum environment (such as via the use of pumps, etc.) within a chamber 114 surrounding the die 102 or could comprise introducing an inert gas or reducing gas into the chamber 114. A favorable environment is thus provided for sintering the metallic powder.

At STEP 126, a simultaneous application of pressure and an electric field is provided to the die 102 in performing of the FAST technique, with the applied pressure, displacement, and temperature of the power being monitored at STEP 128 till completion of the fabrication process at STEP 130, at which time a cool down of the finished component is performed. In performing STEP 126, pressure can be applied to the die 102 and powder compact by way of punch electrodes 110, for example, and the electric field can be provided by a power supply 112 that provides a DC, AC or pulsed power for example. The current that is applied passes through the die and is transferred to the powder of the component being fabricated. Therefore, the heat applied for sintering is generated internally within the component, so as to facilitate a very rapid heating or cooling rate (up to 1000 K/min) in the powder compact. The simultaneous application of pressure and current (and the rapid heating achieved thereby) serves to enhance atom mobility in the power compact being produced, so as to provide the capability of densifying the powder with nanosize or nanostructure, while avoiding coarsening which accompanies standard densification routes. As such, the FAST technique 120 can produce x-ray tube components having full or near-full material density—thereby potentially improving the material properties of the components, such as toughness, fatigue growth crack rate (FGCR), modulus of elasticity, dielectric constant, and/or ductile brittle transition temperature (DBTT), as non-limiting examples. While not shown in FIG. 4, according to one embodiment, it is recognized that a mechanism for providing supplemental temperature increases to the die and can be provided to further increase the rate of heating of the fabricated component, so as to further increase atom mobility.

According to embodiments of the invention, in employing technique 120 for example, mechanical pressure of up to 100 MPa can be applied along with a high current of up to 10,000 A, so as to create a high heating rate of up to 500 degrees Celsius per minute and generate temperatures of up to 2400 degrees Celsius. When providing these conditions in a vacuum or inert environment, high density (e.g., 96-99% relative density), near-net shape x-ray tube components can be fabricated at a fraction of the conventional press-sinter-forge (PSF) cycle time—with cycle times of 5 minutes being achievable with a FAST process.

Referring now to FIGS. 5-8, various x-ray tube components that may be fabricated using a FAST process, such as technique 120, are shown according to embodiments of the invention. It is recognized that the components shown in FIGS. 5-8 are meant to be exemplary only and it is understood that the examples provided do not limit the scope of the invention—as various other components in the x-ray tube 12 could be fabricated using the FAST process.

Figure 5:
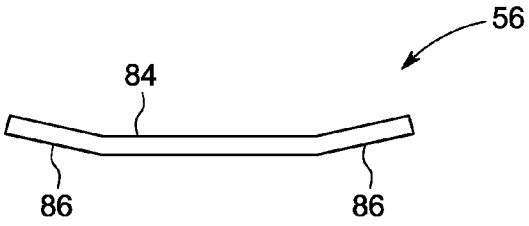
FIG. 5 illustrates an x-ray tube component that may be fabricated using the fabrication process of FIG. 4 according to an embodiment of the present invention.

Referring first to FIG. 5, an anode 56 (i.e., anode target) is shown that is formed using a FAST process. According to an exemplary embodiment, both of a target substrate 84 and target track 86 of the anode 56 can be co-created in a single FAST fabrication process, with the target track 86 being formed of a tungsten or tungsten-rhenium alloy and the substrate being formed of molybdenum or of TZM (Titanium, Zirconium, and Molybdenum), for example. According to one embodiment, using the FAST process, target substrate 84 and target track 86 can be co-created by way of a powder layup or stackup of the target track material and the target substrate material being provided within a die (e.g., die 102 of system 100) and a single FAST process then being performed on the powder layup. According to an alternative embodiment, fully dense or not fully dense pre-forms or monolithic blocks (including green bodies of previously pressed powder) are formed/provided for the layup for forming the target track and the target substrate, with a single FAST process then being performed on the fully dense or not fully dense pre-forms layup. By selectively controlling the processing window of the FAST process, including temperature, pressure, and applied DC current, co-creation of the target substrate 84 and target track 86 of the anode 56 is enabled.

Figure 6:
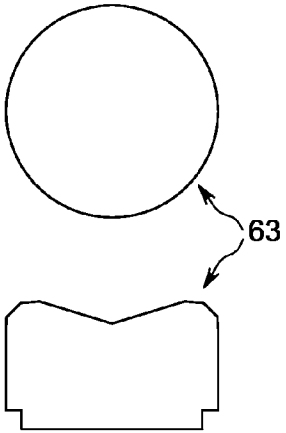
FIG. 6 illustrates an x-ray tube component that may be fabricated using the fabrication process of FIG. 4 according to an embodiment of the present invention.
Figure 7:
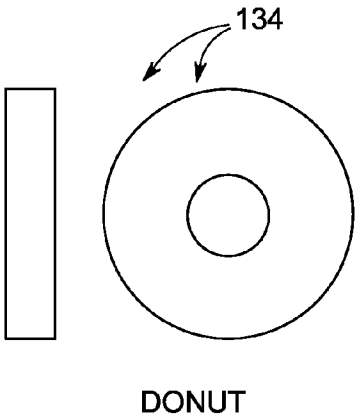
FIG. 7 illustrates an x-ray tube component that may be fabricated using the fabrication process of FIG. 4 according to an embodiment of the present invention.
Figure 8:
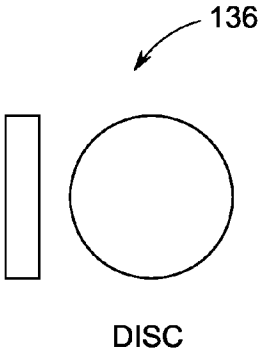
FIG. 8 illustrates an x-ray tube component that may be fabricated using the fabrication process of FIG. 4 according to an embodiment of the present invention.

FIGS. 6-8 show additional x-ray tube components that may be fabricated using a FAST process, such as a cathode cup 63 (FIG. 6), donut 134 (FIG. 7), and disc 136 (FIG. 8) that are included in the x-ray tube 12. Additional components—such as the anode shaft, bearing components, and/or an electron collector may also be fabricated using a FAST process.

Beneficially, embodiments of the invention thus provide a FAST process that produces near-net-shape, full/near-full density material x-ray tube components, including refractory and non-refractory components. Fabrication of x-ray tube components via a FAST process provides a cost advantage due to efficient material utilization, single-piece flow, and significantly reduced cycle-time, as well as associated inventory improved material efficiency, cost, cycle-time, and inventory. Furthermore, fabrication of x-ray tube components via a FAST process potentially provides components of increased material density, so as to improve material properties such as toughness, FGCR, modulus of elasticity, dielectric constant, and/or DBTT—thereby prolonging the life of such x-ray tube components.

According to one embodiment of the invention, a method of fabricating an x-ray tube component includes providing a powder into an electrically conductive die constructed to have a cavity shaped as the x-ray tube component being fabricated and simultaneously applying a mechanical pressure and an electric field to the die so as to cause sintering of the powder and thereby fabricate the x-ray tube component, wherein the electric field applied to the die generates heat internally in the die that is passed to the powder, so as to heat the powder responsive to the applied electric field.

According to another embodiment of the invention, a method of fabricating an x-ray tube component useable in an x-ray tube includes providing a powder into an electrically conductive die, wherein the powder comprises one of a refractory metallic powder, a non-refractory metallic powder, and a ceramic powder, and wherein the die is constructed to have a cavity shaped as the x-ray tube component being fabricated. The method also includes compacting the powder into the electrically conductive die and prepping a volume about the die for a subsequent sintering operation, wherein prepping the volume comprises one of creating a vacuum environment about the die or introducing an inert or reducing gas about the die. The method further includes performing a field assisted sintering technology (FAST) process to sinter the powder and thereby fabricate the x-ray tube component.

According to yet another embodiment of the invention, an x-ray tube component that is configured for use in an x-ray tube is fabricated by providing a powder into an electrically conductive die constructed to have a cavity shaped as the x-ray tube component being fabricated and simultaneously applying a mechanical pressure and an electric field to the die so as to cause sintering of the powder and thereby fabricate the x-ray tube component, wherein the electric field applied to the die generates heat internally in the die that is passed to the powder, so as to heat the powder responsive to the applied electric field.

Embodiments of the invention have been described in terms of the preferred embodiment, and it is recognized that equivalents, alternatives, and modifications, aside from those expressly stated, are possible and within the scope of the appending claims.

What is claimed is:

1. A method of fabricating an x-ray tube component, the method comprising:

providing a powder into an electrically conductive die, wherein the die is constructed to have a cavity shaped as the x-ray tube component being fabricated; and simultaneously applying a mechanical pressure and an electric field to the die so as to cause sintering of the powder and thereby fabricate the x-ray tube component;

wherein the electric field applied to the die generates heat internally in the die that is passed to the powder, so as to heat the powder responsive to the applied electric field.

2. The method of claim 1 wherein the simultaneous application of the mechanical pressure and the electric field comprises a field assisted sintering technology (FAST) process.

3. The method of claim 1 wherein the applied electric field comprises one of a DC current, an AC current and a pulsed DC current.

4. The method of claim 1 wherein the x-ray tube component comprises an anode including a target substrate and a target track, the target substrate being formed from a first refractory metallic powder and the target track being formed from a second refractory metallic powder.

5. The method of claim 4 wherein providing the powder comprises providing a powder layup of the first refractory metallic powder and the second refractory metallic powder within the die.

6. The method of claim 5 wherein providing the powder layup comprises forming monolithic blocks from the first refractory metallic powder and the second refractory metallic powder that are either fully dense or non-fully dense.

7. The method of claim 5 wherein simultaneous application of the mechanical pressure and the electric field co-creates the target substrate and the target track of the anode from the powder layup of the first refractory metallic powder and the second refractory metallic powder.

8. The method of claim 1 further comprising forming one or more monolithic blocks from the powder that are either fully dense or non-fully dense, with the mechanical pressure and electric field being simultaneously applied to the die so as to cause sintering of the monolithic blocks and thereby fabricate the x-ray tube component.

9. The method of claim 1 wherein the powder is heated at a rate of up to 500 degrees Celsius per minute.

10. The method of claim 1 wherein the fabricated x-ray tube component has a relative material density of 96% or greater.

11. The method of claim 1 wherein the powder comprises at least one of molybdenum, molybdenum alloy, tungsten, and a tungsten alloy.

12. A method of fabricating an x-ray tube component useable in an x-ray tube, the method comprising:

providing a powder into an electrically conductive die, wherein the powder comprises one of a refractory metallic powder, a non-refractory metallic powder, and a ceramic powder, and wherein the die is constructed to have a cavity shaped as the x-ray tube component being fabricated;

compacting the powder into the electrically conductive die;

prepping a volume about the die for a subsequent sintering operation, wherein prepping the volume comprises one of creating a vacuum environment about the die or introducing an inert or reducing gas about the die;

performing a field assisted sintering technology (FAST) process to sinter the powder and thereby fabricate the x-ray tube component.

13. The method of claim 12 wherein performing the FAST process comprises:

applying a mechanical pressure to the die; and applying an electric field to the die simultaneously with the application of pressure, wherein the electric field applied to the die directly passes through the die to the refractory metallic powder, so as to generate heat internally within the refractory metallic powder responsive to the applied electric field.

14. The method of claim 12 wherein the fabricated x-ray tube component comprises an anode including a target substrate and a target track, the target substrate being formed from a first refractory metallic powder and the target track being formed from a second refractory metallic powder.

15. The method of claim 14 wherein providing the refractory metallic powder comprises providing a powder layup of the first refractory metallic powder and the second refractory metallic powder within the die; and wherein performing of the FAST process co-creates the target substrate and the target track of the anode from the powder layup of the first refractory metallic powder and the second refractory metallic powder.

16. The method of claim 12 wherein the fabricated x-ray tube component has a relative material density of 96% or greater.

* * * * *